US009010001B2

(12) United States Patent
Manchin et al.

(10) Patent No.: US 9,010,001 B2
(45) Date of Patent: Apr. 21, 2015

(54) TOWEL TAGS TO PERMIT MINIMIZING THE USE OF WATER AND DETERGENT DURING WASHING AND MINIMIZING WEAR AND TEAR OF TOWELS, THE SPREAD OF GERMS AND DISEASES BETWEEN TOWEL USERS, AND MINIMIZING THE USE OF ENERGY, AND SAVING MONEY

(76) Inventors: Susan Manchin, Uniontown, PA (US); Harvey Katz, Boca Raton, FL (US)

( * ) Notice: Subject to any disclaimer, the term of this patent is extended or adjusted under 35 U.S.C. 154(b) by 388 days.

(21) Appl. No.: 13/413,831

(22) Filed: Mar. 7, 2012

(65) Prior Publication Data

US 2012/0227238 A1 Sep. 13, 2012

Related U.S. Application Data

(63) Continuation-in-part of application No. 12/858,254, filed on Aug. 17, 2010, now abandoned.

(51) Int. Cl.
*G09F 3/16* (2006.01)
*G09F 3/08* (2006.01)

(52) U.S. Cl.
CPC ... *G09F 3/08* (2013.01); *G09F 3/16* (2013.01)

(58) Field of Classification Search
CPC ..... G09F 3/16
USPC ..... 40/666, 360
See application file for complete search history.

(56) References Cited

U.S. PATENT DOCUMENTS

| | | | | |
|---|---|---|---|---|
| 1,469,100 | A * | 9/1923 | Mitchell et al. | 40/666 |
| 1,501,000 | A * | 7/1924 | Lane | 40/666 |
| 2,470,811 | A * | 5/1949 | Engleman | 40/658 |
| 5,584,456 | A | 12/1996 | Stephens | |
| 5,960,520 | A | 10/1999 | Conway et al. | |
| 6,405,415 | B1 | 6/2002 | Meeks | |
| 6,645,599 | B1 | 11/2003 | Gabriele | |
| 7,322,068 | B1 | 1/2008 | Kim | |
| 2001/0035672 | A1 | 11/2001 | Graff | |
| 2010/0005693 | A1 * | 1/2010 | Craycroft et al. | 40/360 |
| 2010/0015415 | A1 * | 1/2010 | Hurst et al. | 428/195.1 |
| 2010/0306984 | A1 * | 12/2010 | Fiore et al. | 29/428 |

* cited by examiner

*Primary Examiner* — Gary Hoge
(74) *Attorney, Agent, or Firm* — Nils H. Ljungman & Associates

(57) ABSTRACT

Towel tags to permit minimizing the use of water and detergent during washing and minimizing wear and tear of towels, the spread of germs and diseases between towel users, and minimizing the use of energy, and saving money. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. Any statements made relating to the abstract are not intended to limit the claims in any manner and should not be interpreted as limiting the claims in any manner.

9 Claims, 26 Drawing Sheets

TOWEL TAGS TO PERMIT MINIMIZING THE USE OF WATER AND DETERGENT DURING WASHING AND MINIMIZING WEAR AND TEAR OF TOWELS, THE SPREAD OF GERMS AND DISEASES BETWEEN TOWEL USERS, AND MINIMIZING THE USE OF ENERGY, AND SAVING MONEY

CONTINUING APPLICATION DATA

This application is a Continuation-In-Part application of U.S. patent application Ser. No. 12/858,254, filed on Aug. 17, 2010. U.S. patent application Ser. No. 12/858,254 was pending as of the filing date of this application.

BACKGROUND

1. Technical Field

The present application relates to towel tags to permit minimizing the use of water and detergent during washing and minimizing wear and tear of towels, the spread of germs and diseases between towel users, and minimizing the use of energy, and saving money.

2. Background Information

Background information is for informational purposes only and does not necessarily admit that subsequently mentioned information and publications are prior art.

Towels may be used in a variety of public or places or shared environments where users or towel owners may forget which towel belongs to them, such as a pool, a hotel, a home with multiple occupants, or a dorm room, among other places. Towels may look similar and be easily confused, for example if the towels are white. Using another person's towel may result in the unwanted passing of germs. Infections and diseases, like coughs, colds, skin infections, and other illnesses, may be passed from person to person if a towel is shared.

If individuals are unsure about whether a towel is theirs, they may use more fresh, clean towels unnecessarily instead of reusing a towel to minimize the passing of germs and/or diseases from person to person. Individuals may also wash the towels to minimize the spreading of germs. Frequent washing of towels may result in a wasteful increase in water usage and detergent as well as wear and tear on the towels. If the towel users knew which towel belonged to whom, they could conserve resources and save on water, energy, and detergent costs as well as time. This would be a green solution which could also save money for towel users.

OBJECT OR OBJECTS

An object of the present application is to provide a method of identifying towels, minimizing the spread of germs and diseases, minimizing the use of water and detergent, minimizing the use of energy, and saving money.

SUMMARY

The present application related to towels and a method of identifying towels.

If towels may be kept separate or identified to an individual user, a user may be more likely to reuse the same towel without spreading germs or frequent rewashing of the towel. Tags or identifiers may be used to associate one towel with an individual user to promote reusing of the same towel by the same user. Identifying individual towels of a plurality or set for individual users may be helpful if the towels are the same color or comprise the same pattern and/or design, for example if the towels are white or the towels are striped. The tags may also be used if the towels do not comprise the same color and/or pattern.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
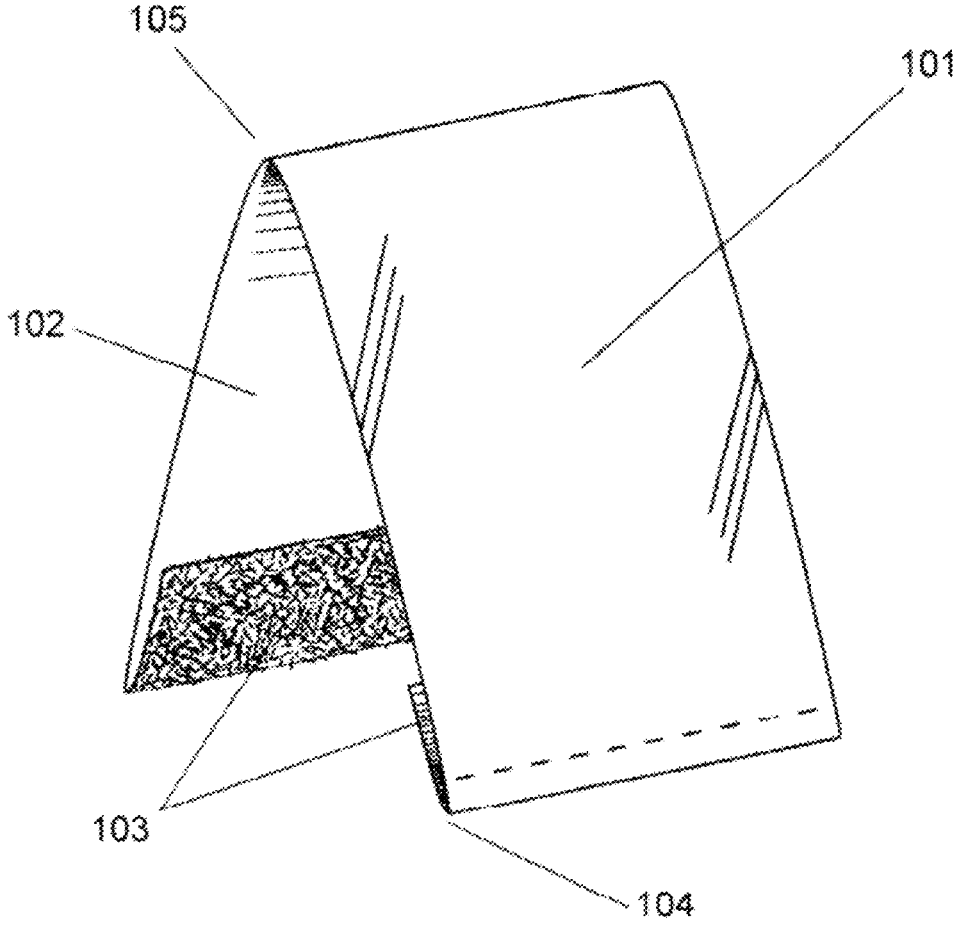
FIG. 1 shows one possible embodiment of the tag of the present application with hook and loop fasteners.

A first embodiment, which may be seen in FIG. 1, is a removable garment tag comprising a fabric where the fabric is further comprised of a first side 102 with one or more attachments, a second side 101 with one or more displays, and one or more folds 105, 104 along the length of the fabric to create various angles for attachment and displays for the first and second sides respectively. The removable tag may also comprise at least one fastener 103.

The removable garment tag can be used on any garment that needs identification or that a user would like to identify, such as a towel, a suitable cuff or collar of a coat, or any other type of garment. The removable garment tag can be comprised of a fabric. Any type of fabric can be used including but not limited to acetate, acrylic, cotton, linen, nylon, polyester, rayon, silk, satin, velvet, denim, felt, flannel, microfiber and blends wherein blend is one or more types of fabric used together on a single removable garment tag as well as any other fabric known to one skilled in the art. The fabric can be of any length or width desired by the user. A longer and/or wider fabric will allow for identification from a longer distance for users, but will also require either more areas of attachment or a larger area of attachment for the attachment of the removable garment tag to the garment.

A first side of the removable garment tag can be a display. The display can be blank, a general design, or customized for a user. The display can identify a garment with its unique appearance and can deter confusion of towels with similar appearance. The display can be attached to the fabric such as an identification that is a separate piece that is connected by any known means including but not limited to such as glue, hook and ladder, stitching, or any other connecting mechanism. Additionally the display can be added directly to the first side of the fabric by any type of visual display including but not limited to types such as screenprinting, woven or stitching, painting, printing using any type of ink or other notation pigment or dye, adding colored glue or glue and then sparkles or other visual remnants in a user desired pattern, dyeing the display one or more colors or any other type of visual display that can be added to a fabric.

In one possible embodiment of the present application, the tag may comprise a unique, identifying characteristic that distinguishes it from another tag. For example, a set of tags may include four tags. Each of the four tags may be a different color, such as a set of red, blue, yellow, and green. Tags may comprise other colors. Other unique, identifying characteristics may be shapes, like circles, squares, rectangles, stars, triangles, polygons, and other similar geometric shapes. Identifying characteristics may also comprise letters, numbers, combinations of letters and/or numbers, names, and words. Identifying characteristics may also comprise objects, symbols, and pictures.

A second side of the removable garment tag can be one or more attachments. The attachment can be any type of affection capable of removal including but not limited to those known by one skilled in the art such as the hook aspect of a hook and loop fastener. The attachment can run the length of the removable garment tag or can be placed in needed areas such as on the ends so the tag can fold over and attach to the garment on each end. The attachment can run the width of the fabric, but may be shorter or may not be shorter if attachment can occur without an attachment running the entire width. The attachment can be affixed to the fabric by any means necessary such as but not limited to stitching, glue or by any means known to one skilled in the art.

In other possible embodiments of the present application, a variety of types of attachments, attaching means, or fasteners may be used. For example, in one possible embodiment of the present application, the male-type fastener component of hook and loop fasteners, such as Velcro, may be used to attach the tag to a terrycloth towel to be identified. The hooks of the male-type fastener may engage with the structure of the towel, namely the loops of the terrycloth.

The removable garment tag may also have one or more folds. A fold may be permanent or non-permanent. A non-permanent fold can be changed; however, a permanent fold could have a reinforcement affixed to the fold to hold the fold. A reinforcement can be any addition that would help hold the fold such as a piece of plastic, a stitch, a coating, or any other type of reinforcement known to one skilled in the art. A single fold would yield two areas of display while every additional fold would yield another area of display. The number of folds would be the choice of the user depending on the number of areas of display desired.

Figure 1A:
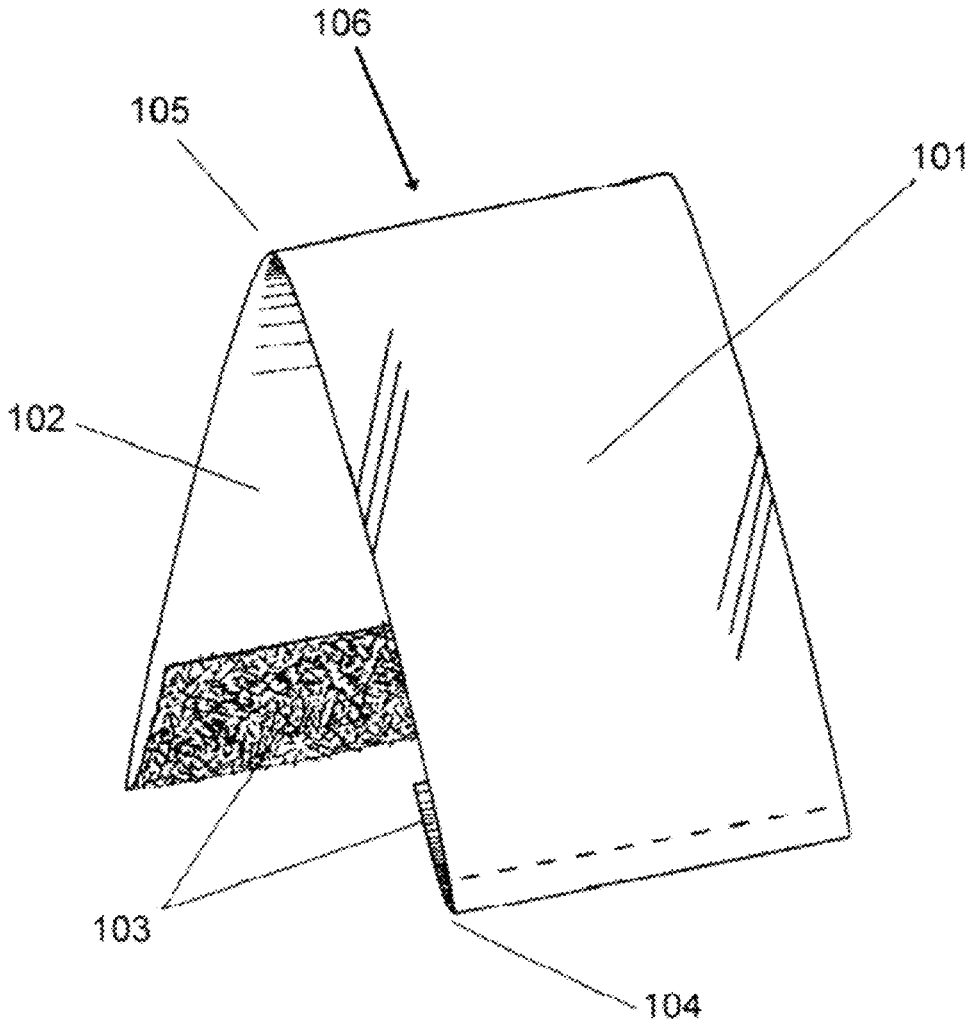
FIG. 1A shows one possible embodiment of a tag similar to the one seen in FIG. 1.

FIG. 1A shows a tag similar to the one seen in FIG. 1. The tag comprises a characteristic 106. In this embodiment, the characteristic 106 may be the color blue.

Figure 1B:
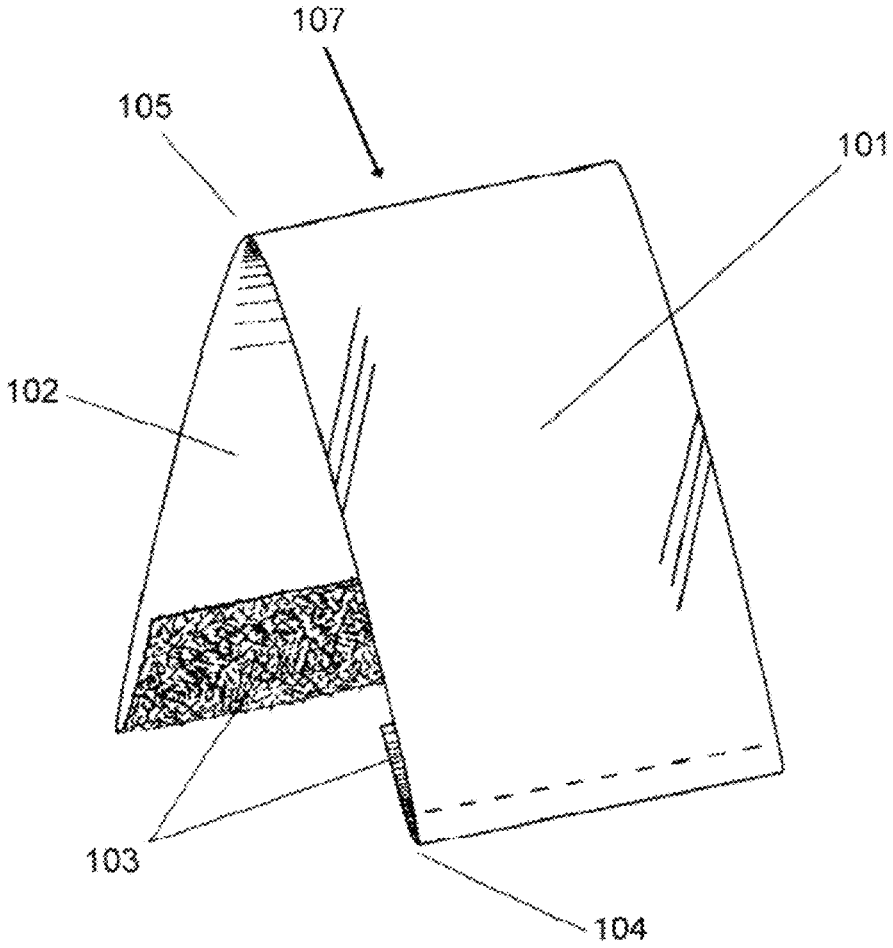
FIG. 1B shows one possible embodiment of a tag similar to the one seen in FIG. 1.

FIG. 1B shows a tag similar to the one seen in FIG. 1. The tag comprises a characteristic 107. In this embodiment, the characteristic 107 may be the color red.

Figure 1C:
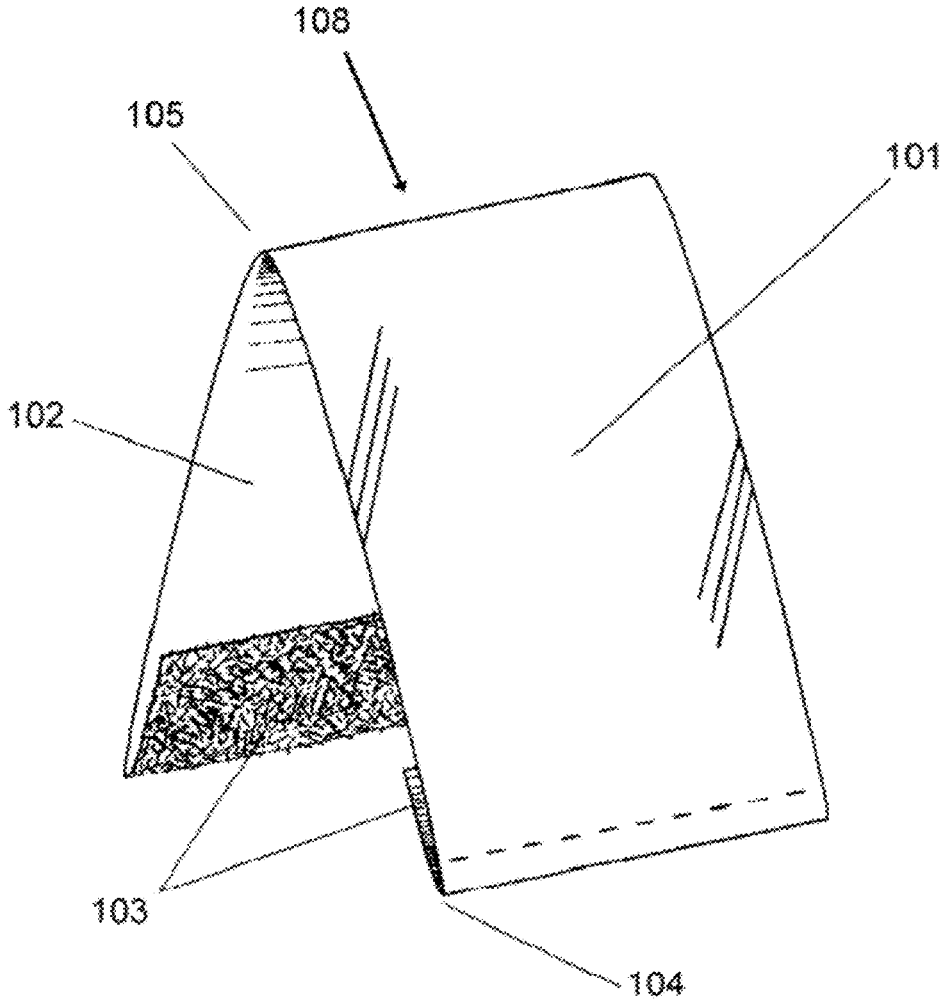
FIG. 1C shows one possible embodiment of a tag similar to the one seen in FIG. 1.

FIG. 1C shows a tag similar to the one seen in FIG. 1. The tag comprises a characteristic 108. In this embodiment, the characteristic 108 may be the color yellow.

Figure 1D:
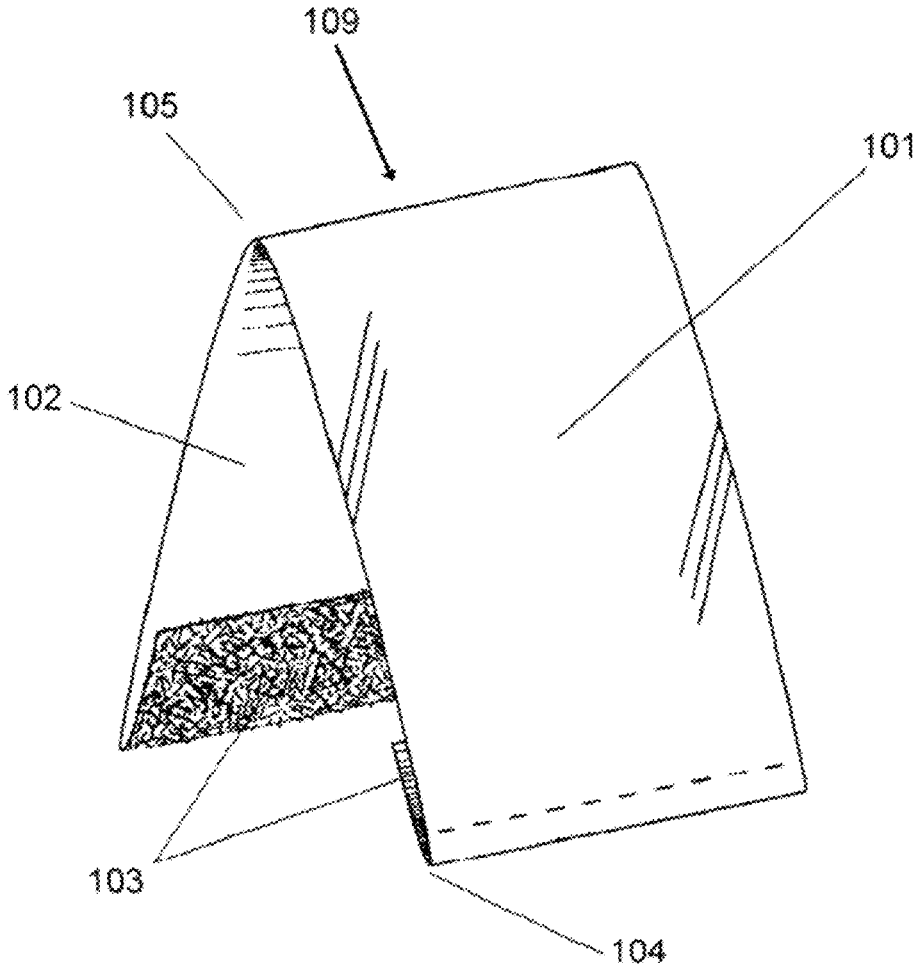
FIG. 1D shows one possible embodiment of a tag similar to the one seen in FIG. 1.

FIG. 1D shows a tag similar to the one seen in FIG. 1. The tag comprises a characteristic 109. In this embodiment, the characteristic 109 may be a shape, symbol, letter, number, a series of letters and/or numbers, or pattern.

Figure 2:
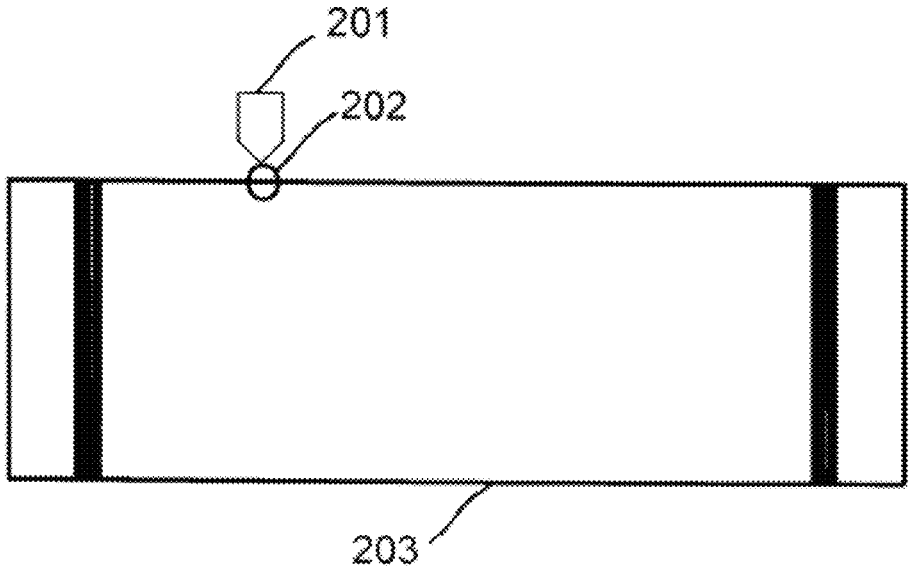
FIG. 2 shows one possible embodiment of the present application with a clasp and a tag, attached with the clasp, identifying a towel.

In other possible embodiments of the present application, such as the embodiment shown in FIG. 2, the attaching means 202 may comprise a ring, clip, clasp, or clamp. In one possible embodiment, a spring-loaded ring 202 comprising a clasp may be used to attach the tag 201 to the material or fabric of the item to be identified 203, in this embodiment a towel 203. The spring-loaded ring 202 may pierce through the fabric or material of the item 203 and engage the structure of the cloth in order to be attached and thereby identify the item 203. Rings of this type may be colored differently to distinguish between the tags and identify the items to an individual user. In such an embodiment, the ring may be the tag, or a tag may be attached to the ring to identify the towel.

Figure 2A:
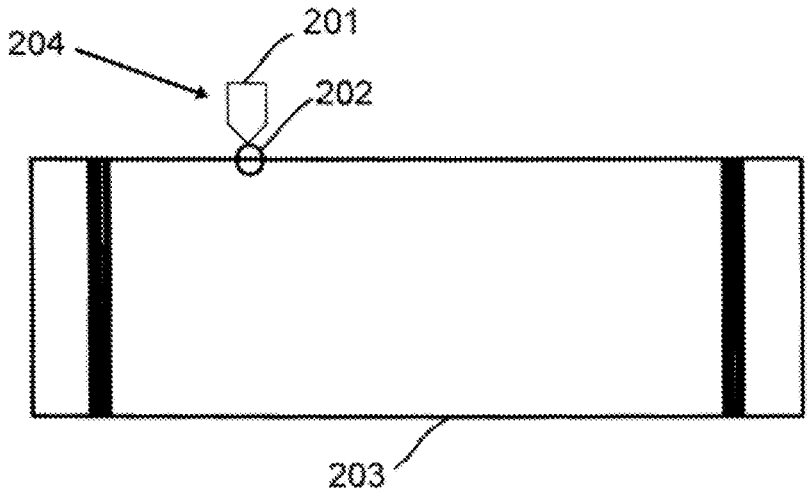
FIG. 2A shows one possible embodiment of a tag similar to the one seen in FIG. 2.

FIG. 2A shows a tag similar to the one seen in FIG. 2. The tag comprises a characteristic 204. In this embodiment, the characteristic 204 may be the color blue.

Figure 2B:
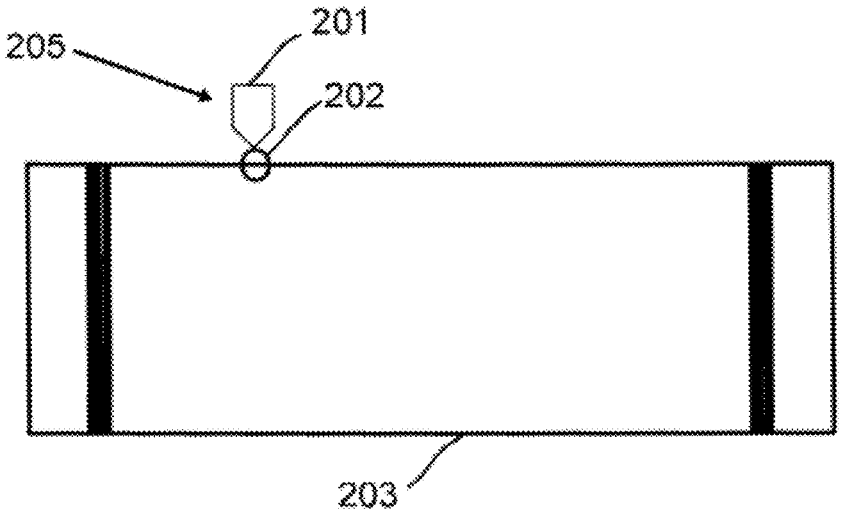
FIG. 2B shows one possible embodiment of a tag similar to the one seen in FIG. 2.

FIG. 2B shows a tag similar to the one seen in FIG. 2. The tag comprises a characteristic 205. In this embodiment, the characteristic 205 may be the color red.

Figure 2C:
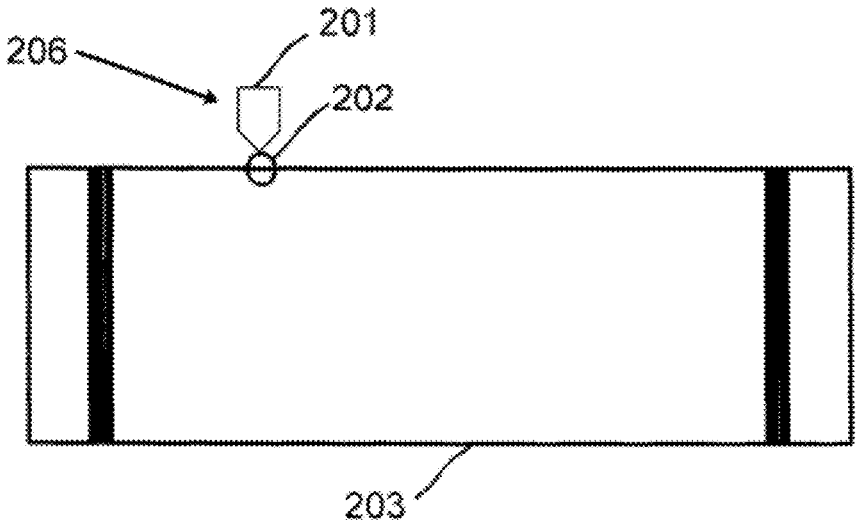
FIG. 2C shows one possible embodiment of a tag similar to the one seen in FIG. 2.

FIG. 2C shows a tag similar to the one seen in FIG. 2. The tag comprises a characteristic 206. In this embodiment, the characteristic 206 may be the color yellow.

Figure 2D:
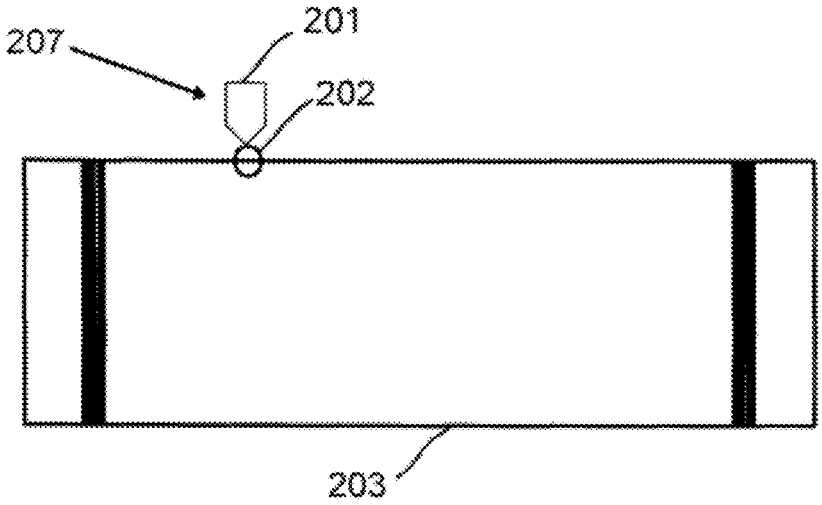
FIG. 2D shows one possible embodiment of a tag similar to the one seen in FIG. 2.

FIG. 2D shows a tag similar to the one seen in FIG. 2. The tag comprises a characteristic 207. In this embodiment, the characteristic 207 may be a shape, symbol, letter, number, a series of letters and/or numbers, or pattern.

Figure 3:
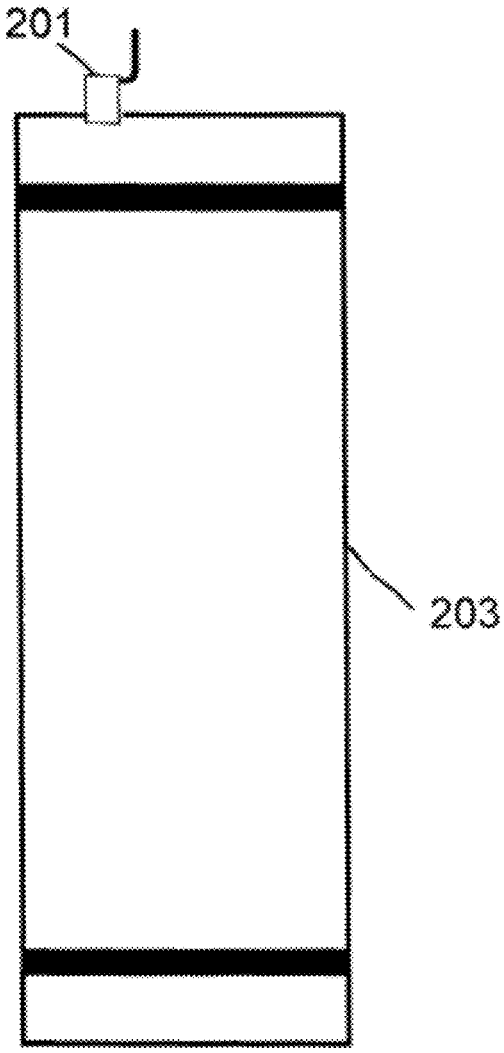
FIG. 3 shows one possible embodiment of the present application with the tag disposed as a loop.

FIG. 3 shows one possible embodiment of the tag 201 of the present application in use with a towel 203. The tag 201 is attached to the towel 203, forming a loop. The loop formed by the tag 201 may be configured to be hung over a hook when not in use by an individual.

Figure 3A:
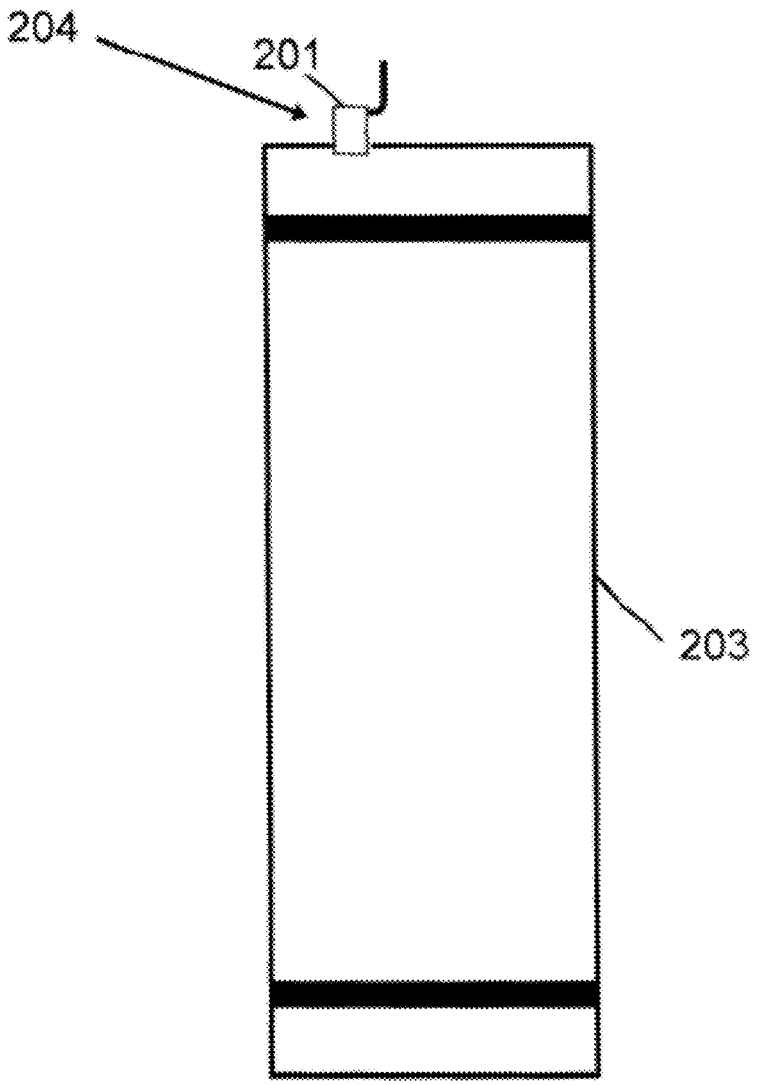
FIG. 3A shows one possible embodiment of a tag similar to the one seen in FIG. 3.

FIG. 3A shows a tag similar to the one seen in FIG. 3. The tag comprises a characteristic 204. In this embodiment, the characteristic 204 may be the color blue.

Figure 3B:
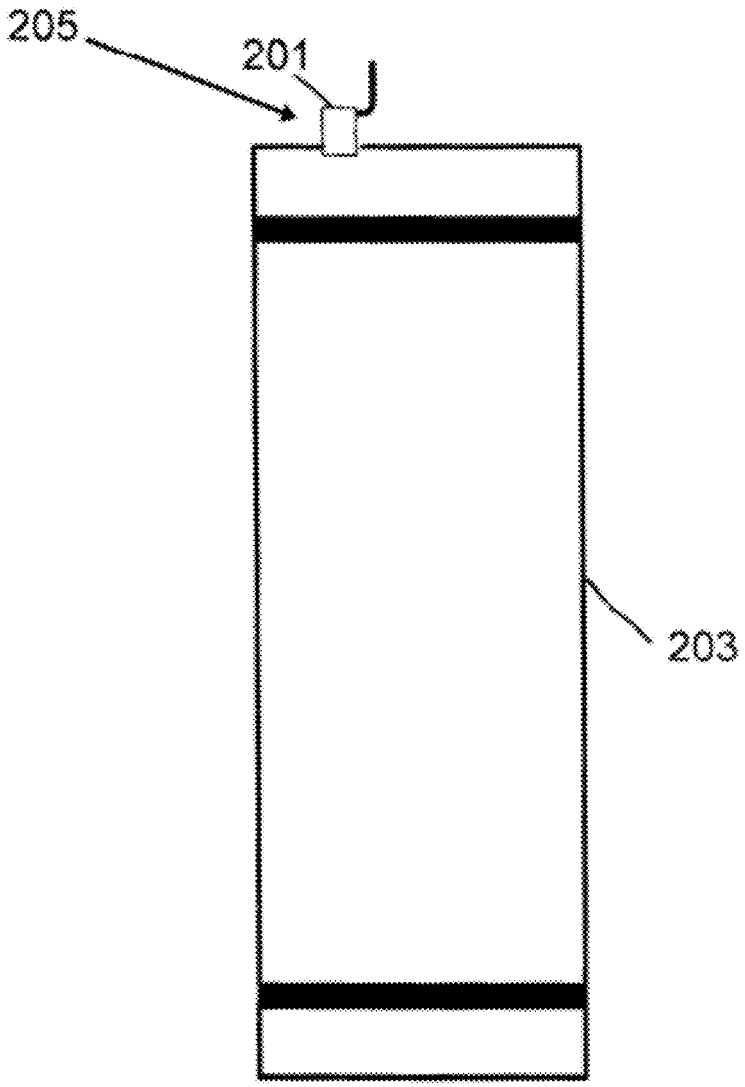
FIG. 3B shows one possible embodiment of a tag similar to the one seen in FIG. 3.

FIG. 3B shows a tag similar to the one seen in FIG. 3. The tag comprises a characteristic 205. In this embodiment, the characteristic 205 may be the color red.

Figure 3C:
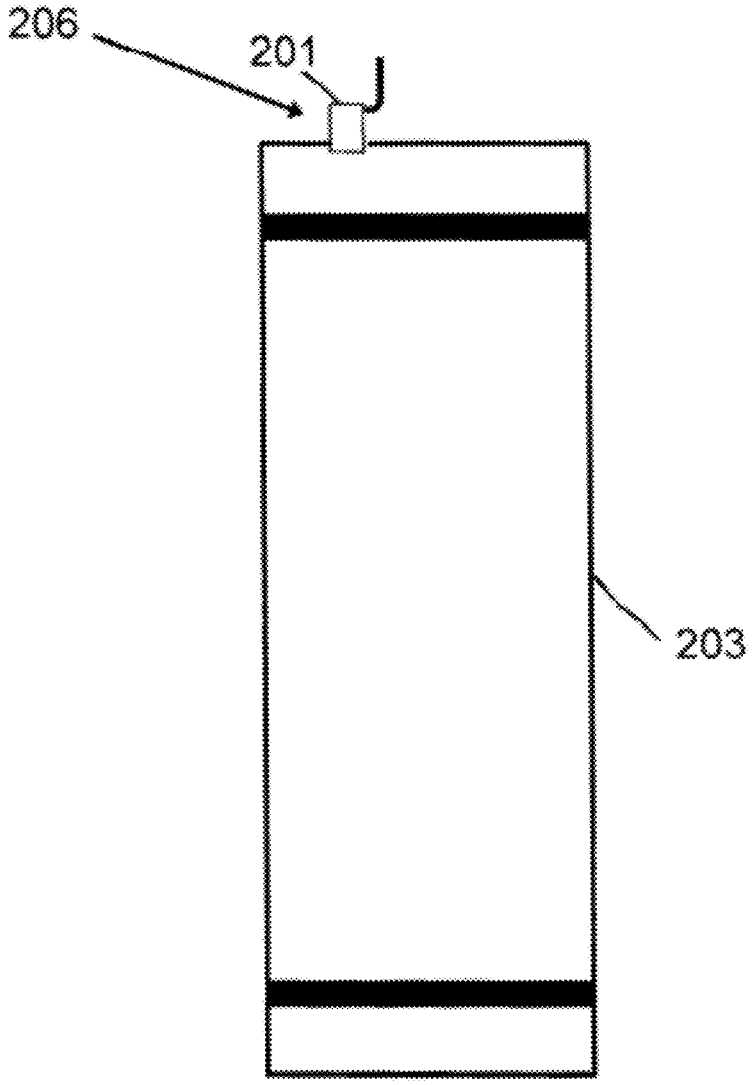
FIG. 3C shows one possible embodiment of a tag similar to the one seen in FIG. 3.

FIG. 3C shows a tag similar to the one seen in FIG. 3. The tag comprises a characteristic 206. In this embodiment, the characteristic 206 may be the color yellow.

Figure 3D:
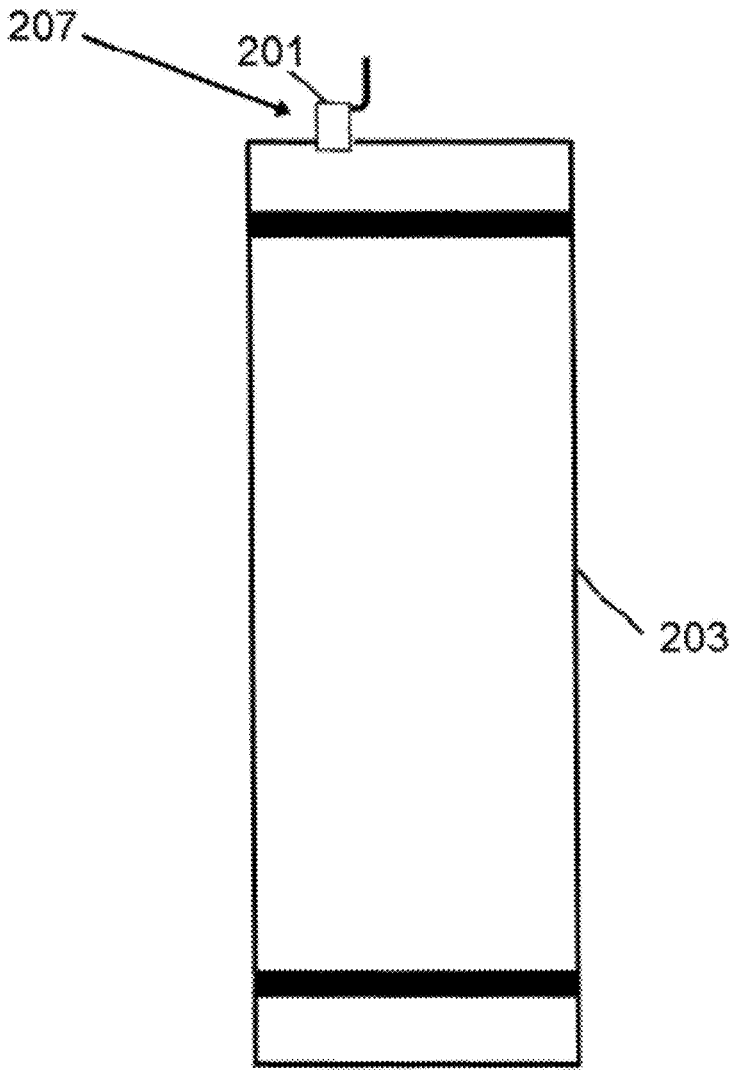
FIG. 3D shows one possible embodiment of a tag similar to the one seen in FIG. 3.

FIG. 3D shows a tag similar to the one seen in FIG. 3. The tag comprises a characteristic 207. In this embodiment, the characteristic 207 may be a shape, symbol, letter, number, a series of letters and/or numbers, or pattern.

Figure 4:
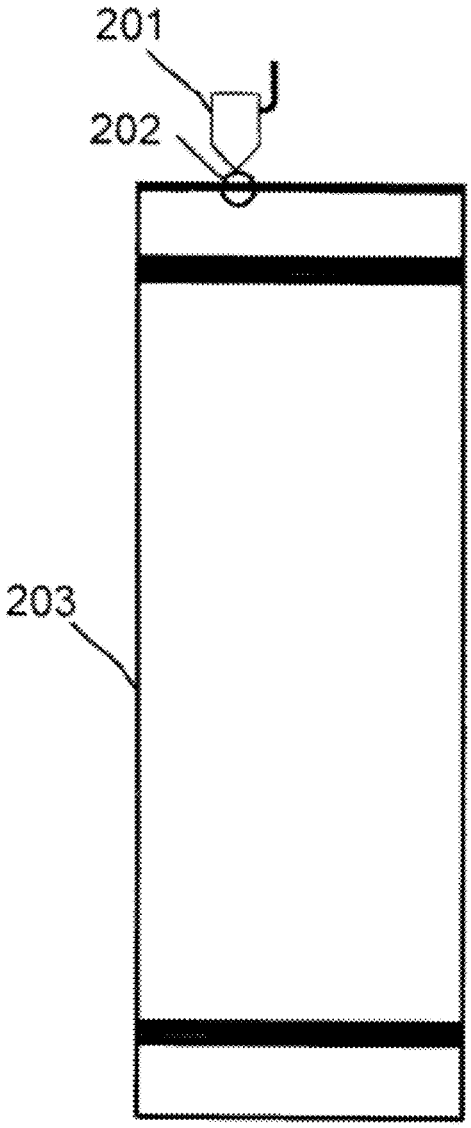
FIG. 4 shows one possible embodiment of a tag according to the present application with the tag disposed as a loop.

FIG. 4 shows one possible embodiment of a tag according to the present application. The tag 201 is attached to the towel 203 by a clasp 202. In this embodiment, the clasp 202 comprises a ring. The tag 201 is disposed as a loop, and the loop is hung over a hook.

Figure 4A:
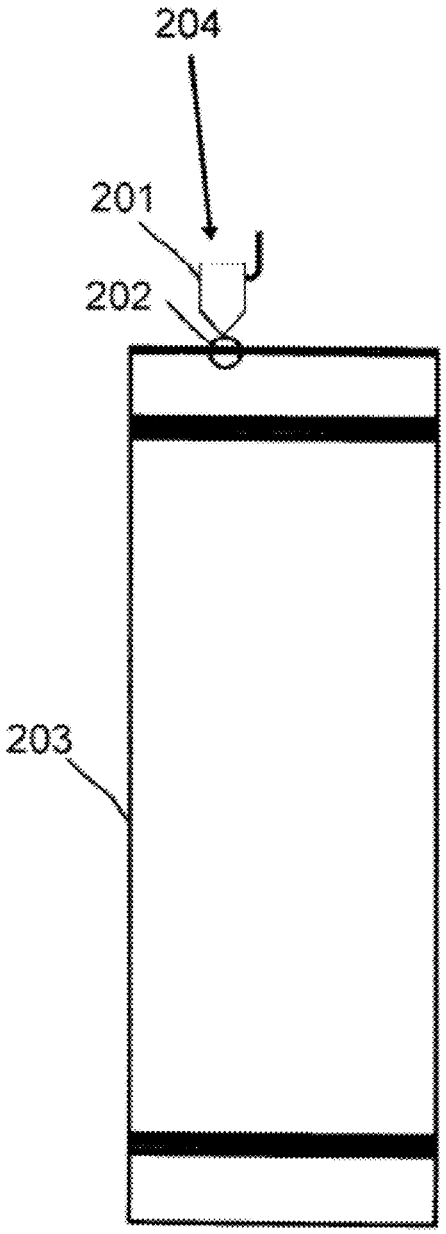
FIG. 4A shows one possible embodiment of a tag similar to the one seen in FIG. 4.

FIG. 4A shows a tag similar to the one seen in FIG. 4. The tag comprises a characteristic 204. In this embodiment, the characteristic 204 may be the color blue.

Figure 4B:
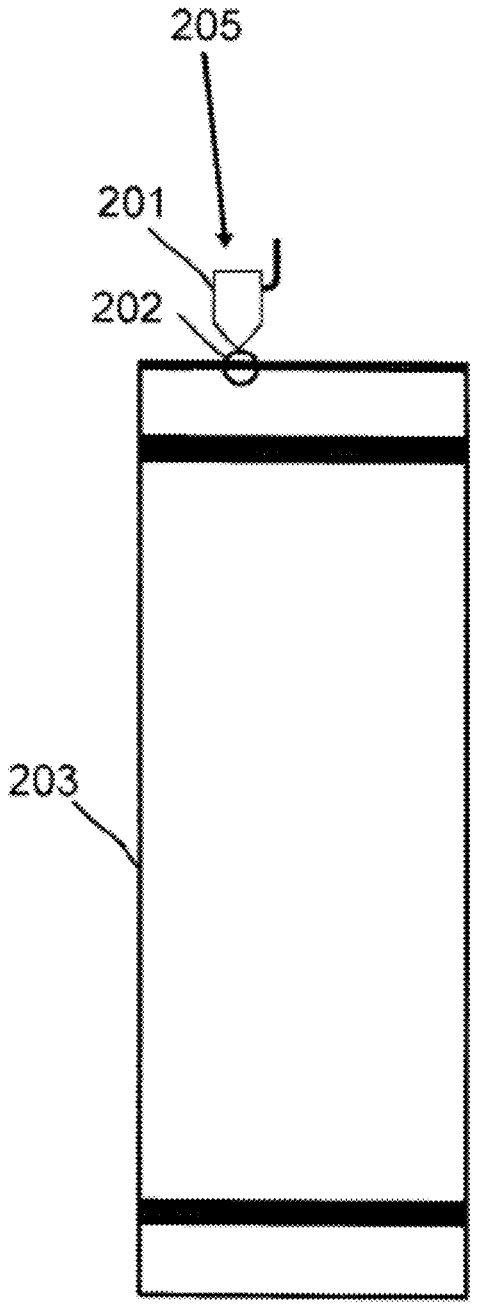
FIG. 4B shows one possible embodiment of a tag similar to the one seen in FIG. 4.

FIG. 4B shows a tag similar to the one seen in FIG. 4. The tag comprises a characteristic 205. In this embodiment, the characteristic 205 may be the color red.

Figure 4C:
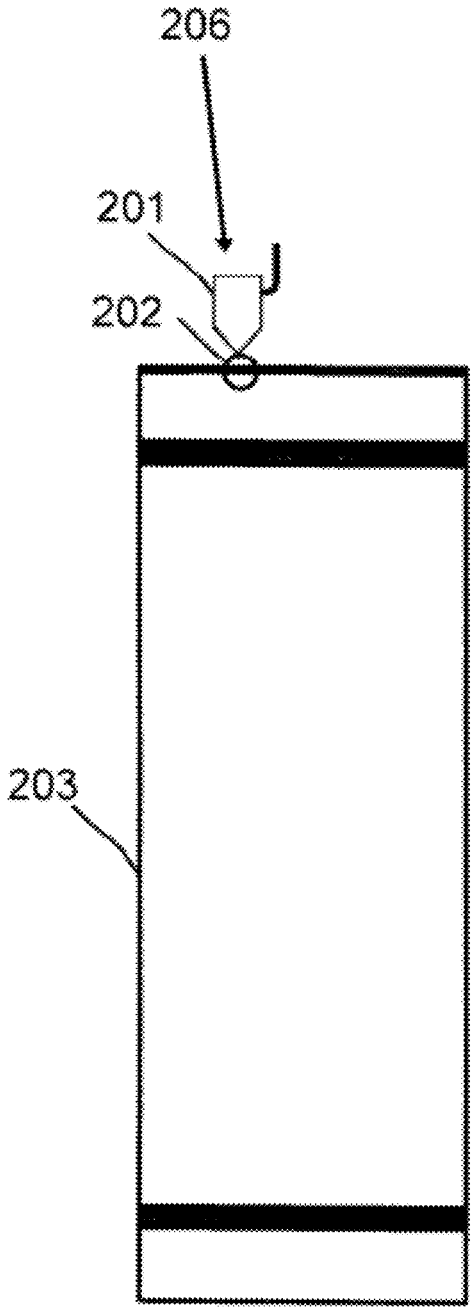
FIG. 4C shows one possible embodiment of a tag similar to the one seen in FIG. 4.

FIG. 4C shows a tag similar to the one seen in FIG. 4. The tag comprises a characteristic 206. In this embodiment, the characteristic 206 may be the color yellow.

Figure 4D:
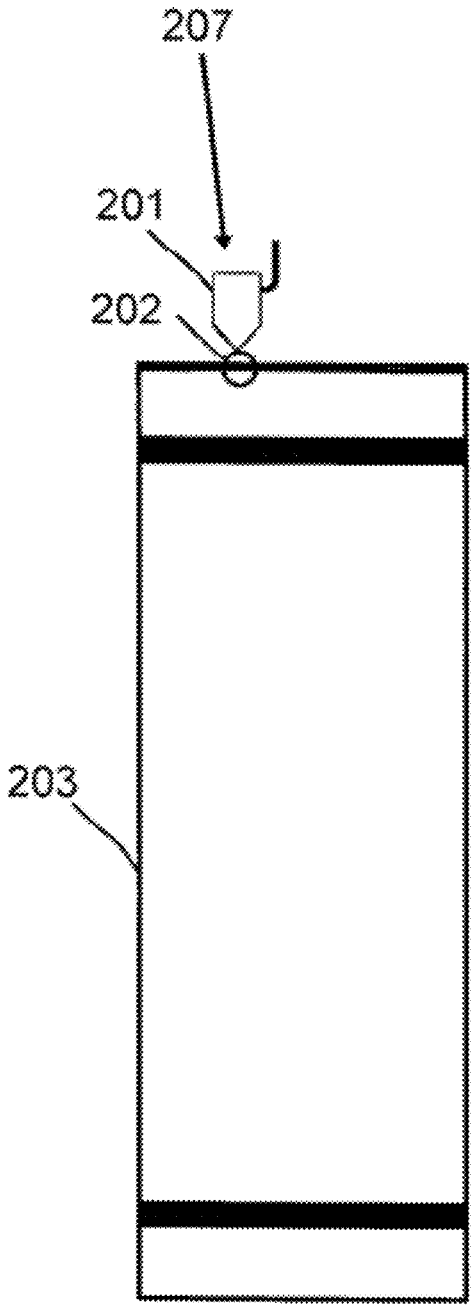
FIG. 4D shows one possible embodiment of a tag similar to the one seen in FIG. 4.

FIG. 4D shows a tag similar to the one seen in FIG. 4. The tag comprises a characteristic 207. In this embodiment, the characteristic 207 may be a shape, symbol, letter, number, a series of letters and/or numbers, or pattern.

Figure 5:
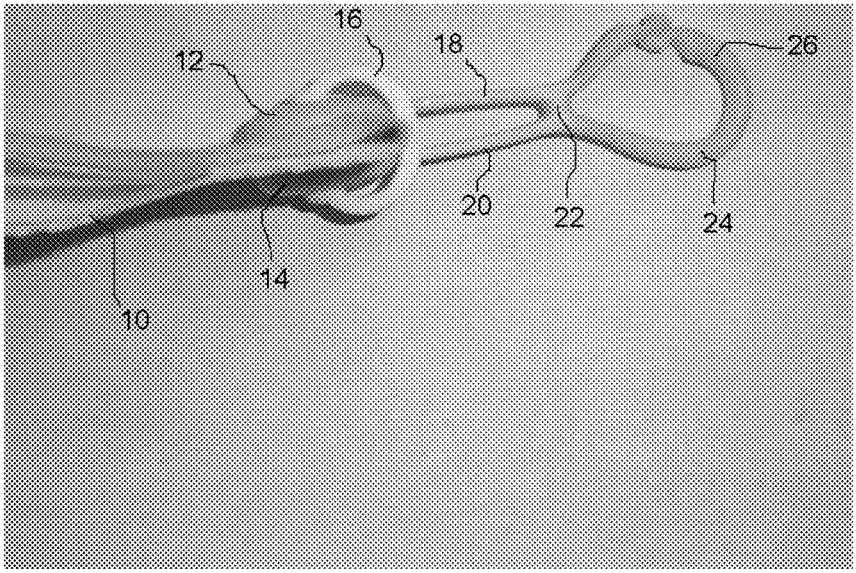
FIG. 5 is a photograph of one possible embodiment of a towel tag according to the present application.

FIG. 5 shows the towel tag holding a towel. The towel 10 is held between the jaws 12 and 14 of the towel tag. The jaws 12 and 14 are held in place by a movable spring clip 16 in order to hold the towel 10 between the jaws 12 and 14. The jaws 12 and 14 being our disposed at the ends of two flexible arms 18 and 20 which extend from a junction point 22 between the arms 18 and 20. Connected also at the junction point 22 is a loop 24 that can be hung on a hook on a wall. In order to be able to hook the loop 24 on a pair of gym pants the hook 24 is formed into parts with an interlocking mechanism 26.

Figure 6:
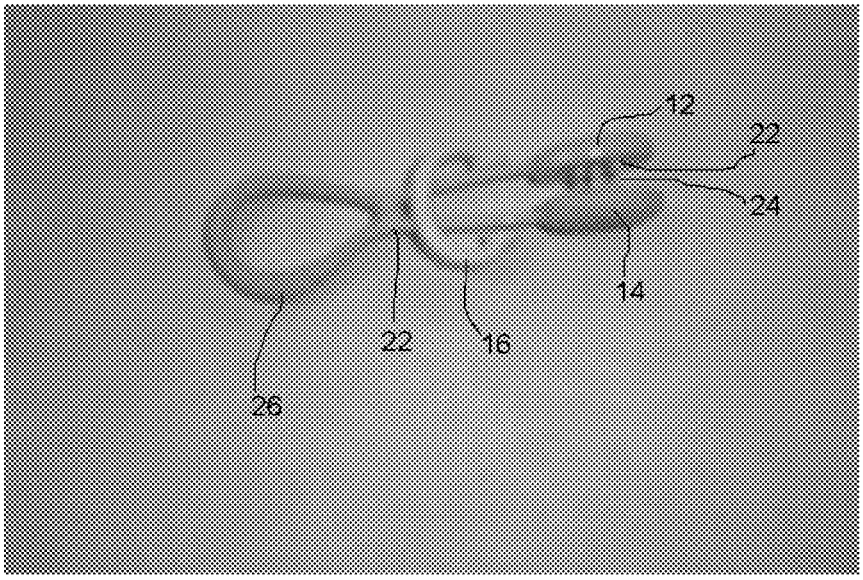
FIG. 6 is a photograph of one possible embodiment of a towel tag according to the present application.

FIG. 6 shows the towel tag with the movable spring clip 16 pushed away from the jaws 12 and 14 to a position adjacent the junction 22 which permits the jaws to part. As can be seen, the jaws 12 and 14 have teeth 22 and 24 to hold the towel between them during washing, for example, in a washing machine. The interlocking mechanism 26 is shown in with the jaws thereof closed.

Figure 7:
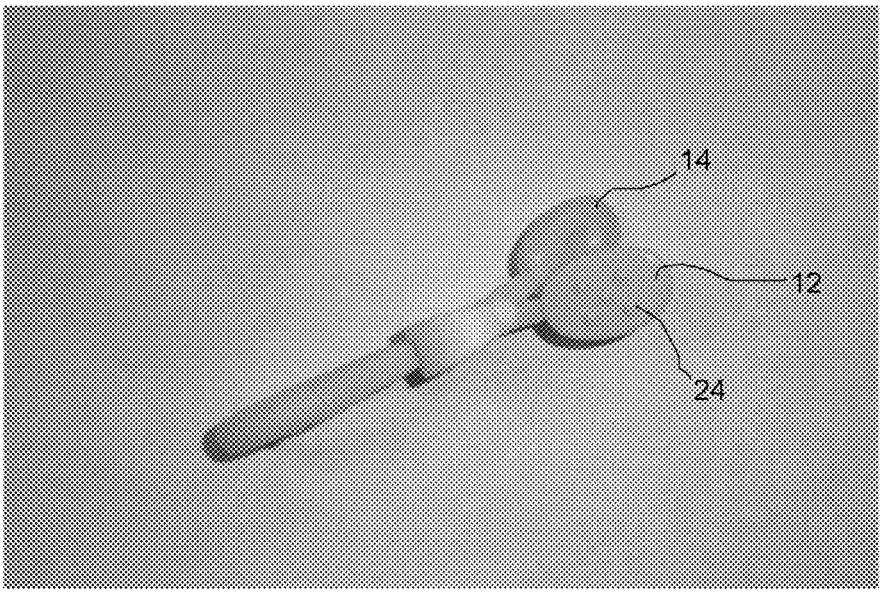
FIG. 7 is a photograph of one possible embodiment of a towel tag according to the present application.

FIG. 7 shows the towel tag with the jaws 12 and 14 twisted out of position in order to show teeth 22 and 24. As can be seen in FIG. 7 jaws 12 has five teeth 22.

Figure 8:
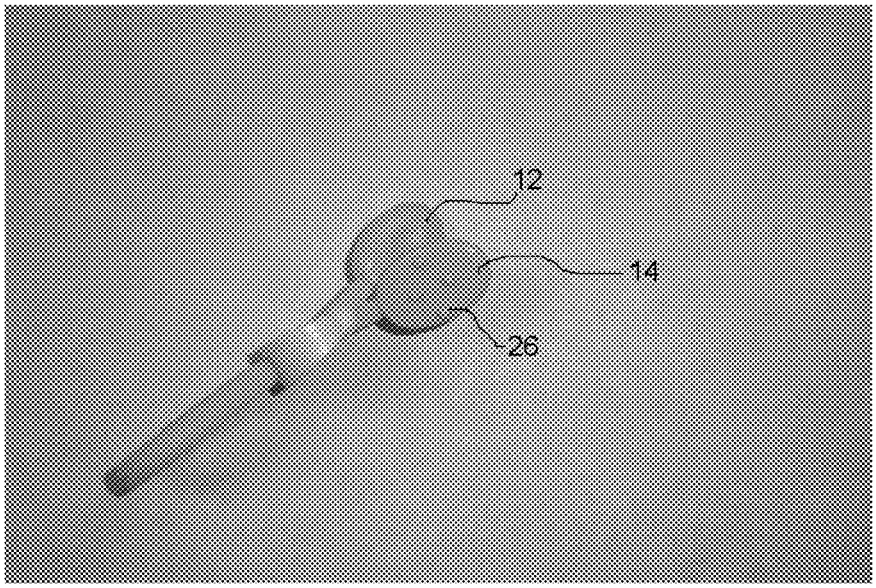
FIG. 8 is a photograph of one possible embodiment of a towel tag according to the present application.

FIG. 8 shows the towel tag with the jaws 12 and 14 twisted out of position and reversed from FIG. 7. As can be seen from FIG. 7 and FIG. 8 the teeth 22 and 24 are positioned such that they connect between one another in order to hold a towel between jaws 12 and 14.

Figure 9:
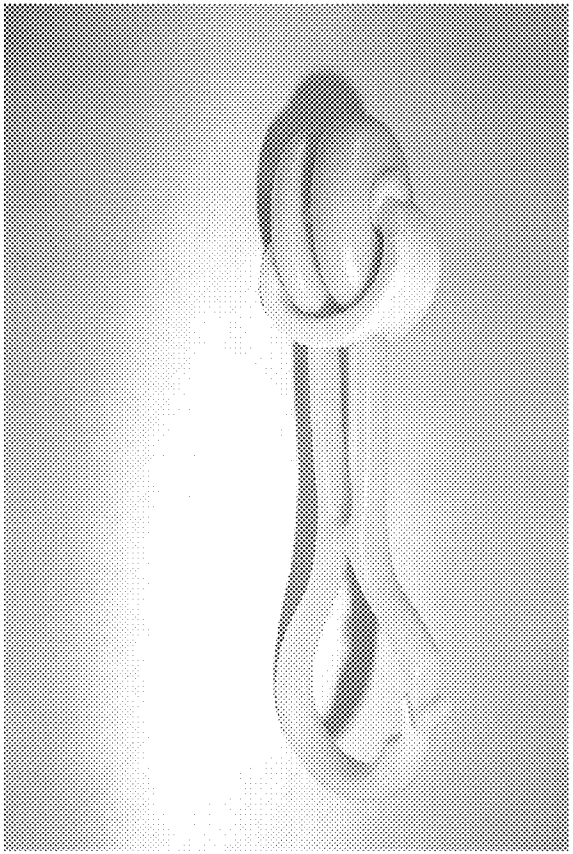
FIG. 9 is a photograph of one possible embodiment of a towel tag according to the present application.

FIG. 9 shows the towel tag with the teeth 22 and 24 clamped together with the jaws 14 and 12 clamped together by the spring 16.

Figure 10:
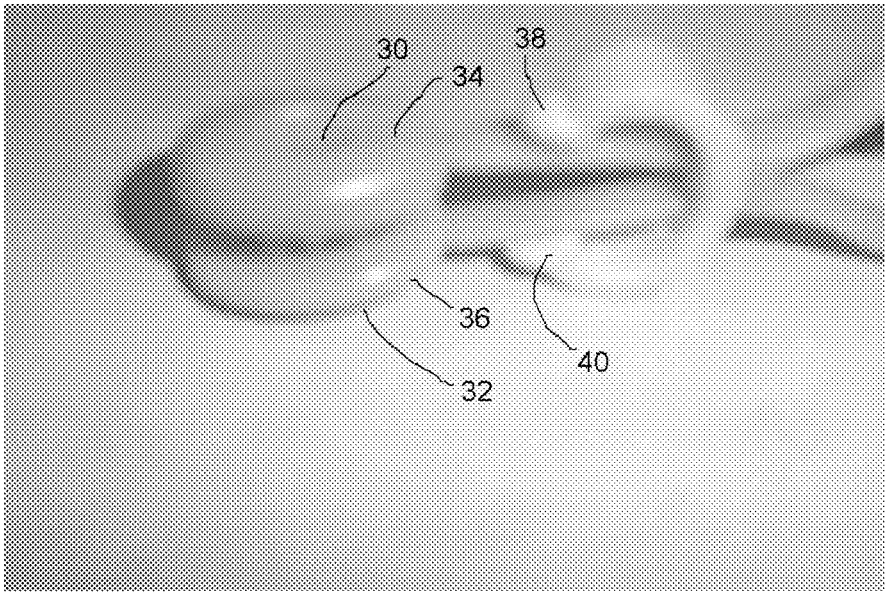
FIG. 10 is a photograph of one possible embodiment of a towel tag according to the present application.

FIG. 10 shows one of the indentations 30 and 32 (not shown) that the pressure members 38 and 40 reside in when the towel is held by the jaws 12 and 13. There is a groove 34 and 36 on each of the jaws 12 and 14 in which the pressure members 38 and 40 slide into engagement with the indentations 30 and 32 and also slide out of these indentations 30 and 32.

These terms and specifications, including the examples, serve to describe the present application by example and not to limit the present application. It is expected that others will perceive differences, which, while differing from the forgoing, do not depart from the scope of the present application herein described and claimed. In particular, any of the function elements described herein may be replaced by any other known element having an equivalent function.

A first embodiment is a removable garment tag comprising a fabric where the fabric is further comprised of a first side with one or more attachments, a second side with one or more displays, and one or more folds along the length of the fabric to create various attachment and display areas for the first and second sides respectively.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of clasps, which may possibly be utilized or adapted for use in at least one possible embodiment of the present application, may possibly be found in the following U.S. Pat. No. 7,347,065, having the title "CLASP ASSEMBLY FOR JEWELRY," published on Mar. 25, 2008; U.S. Pat. No. 6,804,868, having the title "SWIVEL LOCKING CLASP," published on Oct. 19, 2004; U.S. Pat. No. 6,662,597, having the title "APPARATUS AND METHOD FOR CONNECTING TOGETHER AND PROTECTING FIRST AND SECOND ENDS OF AN ARTICLE OF JEWELRY," published on Dec. 16, 2003; U.S. Pat. No. 6,098,202, having the title "BELTLOOP JEWELRY ARTICLE," published on Aug. 8, 2000; U.S. Pat. No. 4,847,957, having the title "MULTI-PURPOSE CLASP," published on Jul. 18, 1989; and U.S. Pat. No. 4,815,180, having the title "TRANSFERRABLE JEWELRY CLASP WITH NECK CHAIN OR NECK BAND," published on Mar. 28, 1989.

Some examples of washing machines, which may possibly be utilized or adapted for use in at least one possible embodiment of the present application, may possibly be found in the following U.S. Pat. No. 7,757,324, having the title "AUTOMATIC WASHING MACHINE WITH WASH ACTION TUB RAMPS AND CYCLES; SPIN DRAIN FLOW CHANNELS AND RESERVOIR," published on Jul. 20, 2010; U.S. Pat. No. 7,755,242, having the title "MOTOR, METHOD FOR MANUFACTURING THE SAME, AND WASHING MACHINE USING THE SAME," published on Jul. 13, 2010; U.S. Pat. No. 7,748,243, having the title "WASHING MACHINE," published on Jul. 6, 2010; U.S. Pat. No. 7,748,242, having the title "DRUM TYPE WASHING MACHINE," published on Jul. 6, 2010; and U.S. Pat. No. 7,743,633, having the title "WASHING MACHINE HAVING BALANCER," published on Jun. 29, 2010.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incomparable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of identifying an individual user's towel from a plurality of similar towels for a plurality of users of towels to minimize the use of water and detergent from washing towels, and to minimize the spread of germs and diseases between towel users, said method comprising the steps of:

selecting, from a plurality of similar towels, a towel for a first individual user and a towel for a second individual user;

attaching a first tag to said first individual user's towel, which first tag comprises a first color, by clamping said first individual user's towel between a first jaw and a second jaw of said first tag;

attaching a second tag to said second individual user's towel, which second tag comprises a second color different from said first color, by clamping said second individual user's towel between a first jaw and a second jaw of said second tag;

said first individual user identifying said first tag by said first color, and thereby identifying said first individual user's towel;

said second individual user identifying said second tag by said second color, and thereby identifying said second individual user's towel;

said first individual user using and reusing said first individual user's towel;

said second individual user using and reusing said second individual user's towel;

collecting said first individual user's towel and said second individual user's towel for laundering only upon said first individual user's towel and said second individual user's towel each becoming sufficiently dirty to require laundering;

detaching and removing said first tag from said first individual user's towel by unclamping said first jaw and said second jaw;

detaching and removing said second tag from said second individual user's towel by unclamping said first jaw and said second jaw;

laundering said first individual user's towel and said second individual user's towel, and then placing said laundered towels back into said plurality of similar towels;

selecting again, from said plurality of similar towels, a towel for said first individual user and a towel for said second individual user;

attaching said first tag to said first individual user's towel;

attaching a second tag to said second individual user's towel;

said first tag comprises a loop;

said second tag comprises a loop; and said method further comprises the steps of:

hanging said loop of said first tag on a projection, and thereby hanging said first individual user's towel; and hanging said loop of said second tag on a projection, and thereby hanging said second individual user's towel;

wherein each of said step of attaching said first tag to said first individual user's towel and attaching said second tag to said second individual user's towel comprises one of (A) and (B): (A) engaging the structure of said towel with at least a portion of each of said first jaw and said second jaw, and (B) engaging through the structure of said towel with at least a portion of each of said first jaw and said second jaw;

each of said first and second tags comprises first and second arms;

each of said first and second arms comprises a first end and a second end opposite said first end;

said first jaw is connected to said first end of said first arm;

said second jaw is connected to said first end of said second arm;

each of said first jaw and said second jaw comprises projections disposed adjacent and to project toward one another;

said second end of said first arm is connected to said second end of said second arm at a junction point; and said loop is connected to said junction point.

2. The method according to claim 1, wherein:

each of said first tag and said second tag comprises a spring arrangement configured to hold said first jaw and said second jaw together upon being attached to a towel; and said step of clamping comprises engaging and holding said first jaw and said second jaw in place with said spring arrangement.

3. The method according to claim 2, wherein:

said spring arrangement is supported on said arms and configured to be moved along said arms between an engaged position in which said spring arrangement exerts a pressing force on said first jaw and said second jaw, and a disengaged position in which said spring arrangement does not exert a pressing force on said first jaw and said second jaw; and said method further comprises moving said spring arrangement along said arms between said engaged position to clamp a towel and said disengaged position to release a clamped towel or permit insertion of a towel between said first jaw and said second jaw.

4. The method according to claim 3, wherein:

said spring arrangement comprises a substantially C-shaped body and two pressure members, one disposed at each end of said C-shaped body;

each of said first jaw and said second jaw comprises an outer surface configured and disposed to face away from said projections, in which outer surface an indentation is formed;

said spring arrangement is configured to be moved along said arms to said engaged position in which said pressure members each engage a corresponding one of said indentations on said outer surfaces of said first and second jaws, to thereby exert a pressing force on said first and second jaws to securely clamp a towel therebetween; and said spring arrangement is configured to be moved along said arms to said disengaged position in which said pressure members are disengaged from a corresponding one of said indentations on said outer surfaces of said first and second jaws, to thereby permit opening of said first and second jaws to permit insertion of a towel in between said first and second jaws and removal of a towel from in between said first and second jaws.

5. The method according to claim 4, wherein:

each of said first and second tags comprises at least one additional identifying characteristic comprising one of: shapes, symbols, letters, numbers, patterns, names, words, objects, pictures, and a combination thereof; and said steps of identifying said first and second tags comprise identifying each of said first and second tags by both its color and its at least one additional identifying characteristic.

6. The tag according to claim 5, wherein:

said tag comprises at least one identifying characteristic configured to permit a user to identify said tag from other tags, and to thereby identify the individual user of a towel held by said tag; and said at least one identifying characteristic comprises one of: colors, shapes, symbols, letters, numbers, patterns, names, words, objects, pictures, and a combination thereof.

7. The method according to claim 1, wherein said step of hanging said loop of said first tag on a projection comprises hanging said loop on a hook, and said step of hanging said loop of said second tag on a projection comprises hanging said loop on a hook.

8. The method according to claim 7, wherein said projections of said jaws comprise teeth.

9. The method according to claim 1, wherein said projections of said jaws comprise teeth.

* * * * *